United States Patent [19]

Tax

[11] 3,957,161

[45] May 18, 1976

[54] ROTARY CRANE

[76] Inventor: Hans Tax, Potsdamer Strasse 3, 8 Munich 40, Germany

[22] Filed: July 15, 1974

[21] Appl. No.: 488,894

[30] Foreign Application Priority Data

Aug. 9, 1973 Germany ..... 2340428

[52] U.S. Cl. ..... 212/69; 74/63; 192/84 T; 212/59 R

[51] Int. Cl.[2] ..... B66C 23/84

[58] Field of Search ..... 212/66–69, 212/59 R; 214/151, 132; 74/63; 192/51, 84 T

[56] References Cited

UNITED STATES PATENTS

| | | | |
|---|---|---|---|
| 272,988 | 2/1883 | Thompson | 192/51 |
| 1,855,892 | 4/1932 | Schiebeler | 212/69 |
| 2,405,642 | 8/1946 | Corte | 192/51 |
| 2,596,654 | 5/1952 | Clark et al. | 192/84 T |
| 2,599,677 | 6/1952 | Waguespack | 212/66 |
| 3,029,955 | 4/1962 | Perkins | 212/69 |
| 3,144,921 | 8/1964 | Martinek | 192/58 |
| 3,439,787 | 4/1969 | Minciotti et al. | 192/51 |
| 3,463,020 | 8/1969 | Gelb | 192/84 R |

*Primary Examiner*—Albert J. Makay
*Assistant Examiner*—Lawrence J. Oresky
*Attorney, Agent, or Firm*—Hans Berman

[57] ABSTRACT

An improved drive for rotating the boom-carrying portion of a rotary crane on the base portion of the crane about an upright axis employs an electric motor rotating continuously in one direction when energized and operatively connected to a drive element rotatable on one of the crane portions. The drive element engages the other crane portion and thereby rotates the boom-carrying portion. The motion transmitting train which connects the motor to the drive element includes an electromagnetic coupling whose slip may be controlled to vary the torque transmitted from the motor to the drive element.

4 Claims, 3 Drawing Figures

ROTARY CRANE

This invention relates to rotary cranes, and particularly to a drive arrangement for rotating the boom-carrying portion of the crane relative to the base portion.

In known drive arrangements for rotary cranes, electric motors whose rotors have a squirrel cage winding or are energized by way of slip rings were employed. While the direction of rotation of squirrel cage motors is conveniently changed by polarity reversal, they are not well suited for use in crane drives of the type described because of their high starting torque. The sudden shock exerted on the entire drive mechanism at each start-up causes the rapid wear of motion transmitting elements. A squirrel cage motor also does not permit speed variation. When the motor is frequently started and stopped, as is necessary in normal crane operation, much heat is generated which is difficult to dissipate.

Motors with slip ring rotors may be equipped with variable resistors in their rotor circuits which permit torque and rotary speed to be controlled so that they start smoothly and gradually. They generate less heat than intermittently operated squirrel cage motors. The control equipment needed by a motor of this type, however, is bulky and costly.

It is a primary object of this invention to provide a drive arrangement for a rotary crane actuated by an electric motor which avoids the shortcomings of the afore-described known devices.

According to one of the more specific aspects of this invention, the drive arrangement includes an electric motor which rotates continuously in one direction when energized, and a drive element rotatable on the base portion or the boom-carrying portion of the crane and engaging the other crane portion for rotating the boom-carrying portion. A motion transmitting train operatively interposed between the motor and the drive element includes an electromagnetic coupling and manually operable controls for varying the slip in the coupling and for thereby varying the torque transmitted from the motor to the drive element. The drive train preferably also includes reversing gearing for reversing the direction of rotation of the drive element while the motor rotates continuously in one direction. Squirrel cage motors are entirely acceptable in the drive arrangements of the invention, and usually preferred because of their simplicity. A speed-reducing transmission is usually needed in the drive train, and the electromagnetic coupling is then arranged between the motor and the speed-reducing transmission.

Other features, additional objects, and many of the attendant advantages of this invention will readily be appreciated as the same becomes better understood by reference to the following detailed description of preferred embodiments when considered in connection with the appended drawing in which.

Figure 1:
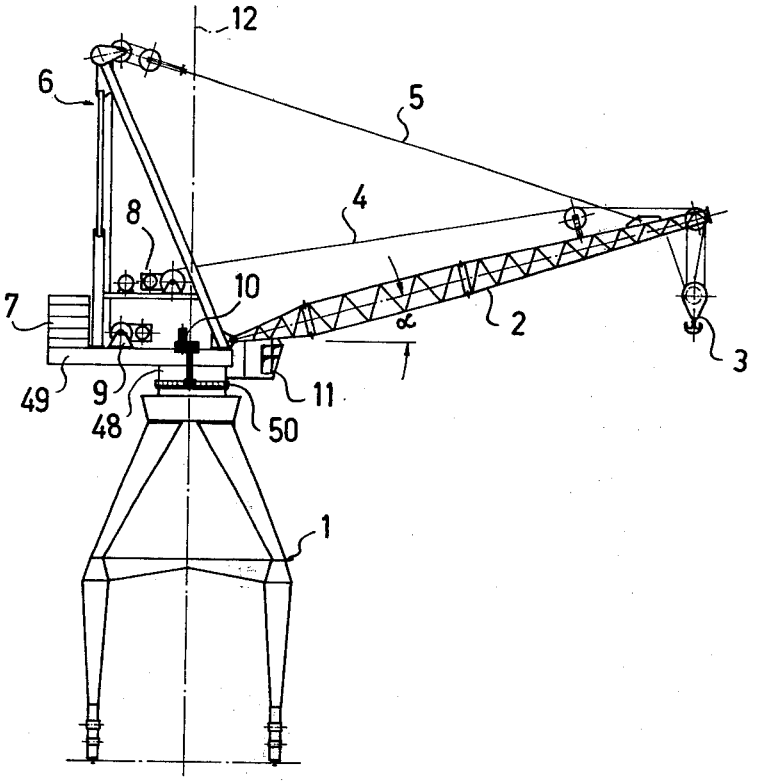
FIG. 1 shows an otherwise conventional rotary crane equipped with a drive arrangement of the invention.

Referring now to the drawing in detail, and initially to FIG. 1, there is shown a crane whose base portion is a gantry 1. A turntable 48 atop the gantry 1 supports a platform 49 to which the boom 2 of the crane is pivoted. A hook 3 depending from the free end of the boom 2 on a hoisting cable 4 may be raised or lowered by means of a winch 8 on the platform 49. The angle of inclination $\alpha$ of the boom 2 relative to the horizontal may be varied by means of a cable 5 whose ends are attached to the free end of the boom 2 and to a winch 9 on the platform 49 respectively, and which is trained over an upright beam 6 on the platform. A counterweight 7 on the platform 49 at least partly balances the weight of the boom 2 and of a load suspended therefrom. An operator's cab 11 is mounted on the platform 49 for an unobstructed view of a load suspended from the hook 3.

The structure described so far is conventional. The information is more specifically concerned with the drive mechanism 10 on the boom-carrying platform 49 which meshingly engages a gear rim 50 on the stationary base of the turntable 48 for turning the platform 49 about the upright axis 12 of the turntable.

Figure 2:
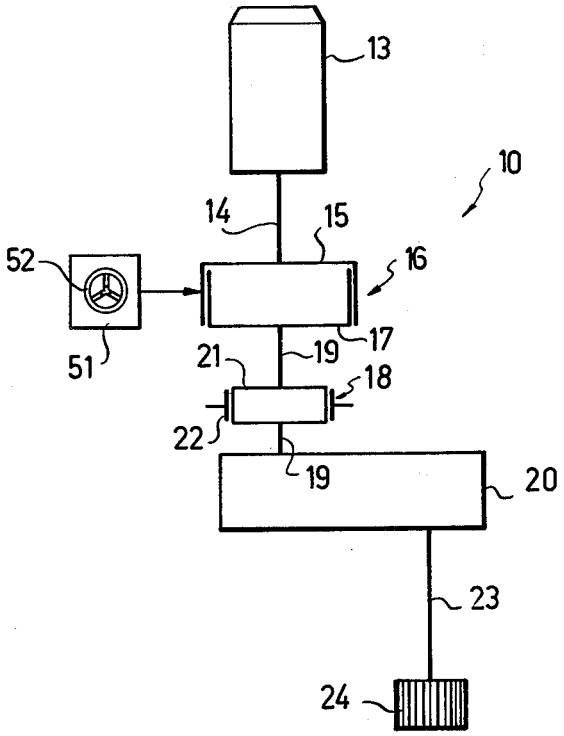
FIG. 2 shows a first drive arrangement of the invention.

A first drive mechanism 10 is shown in FIG. 2. It includes an electric motor 13 having a squirrel cage rotor, and therefore reversible. A blower for cooling air is built into and obscured by the shell of the motor 13. The output shaft 14 of the motor is coaxially fastened to the driven or input member 15 of an eddy current clutch or coupling 16 whose driving or output member 17 is attached to a shaft 19 carrying the drum 21 of a drum brake 18. The brake shoes 22 of the brake may be frictionally engaged with the drum 21 in a conventional manner not specifically illustrated by an operator in the cab 11 to brake the shaft 19 when no significant torque is transmitted by the coupling 16. The shaft 19 also constitutes the input shaft of a speed-reducing gear transmission 20 whose output shaft 23 carries a pinion 24. The entire apparatus shown in FIG. 2 is mounted on the platform 49, and the pinion 24 meshingly engages the gear rim 50 to turn the boom-carrying crane portion at a speed which may be set by a handwheel 51 on the electrical control box 52 for the coupling 16. The controls in the box 52 may include, for example, two series connected potentiometers which control the field of the clutch. Torque adjustment is necessary, for example, when the inertia of the boom-carrying crane portion is changed by grossly altering the angle $\alpha$.

Figure 3:
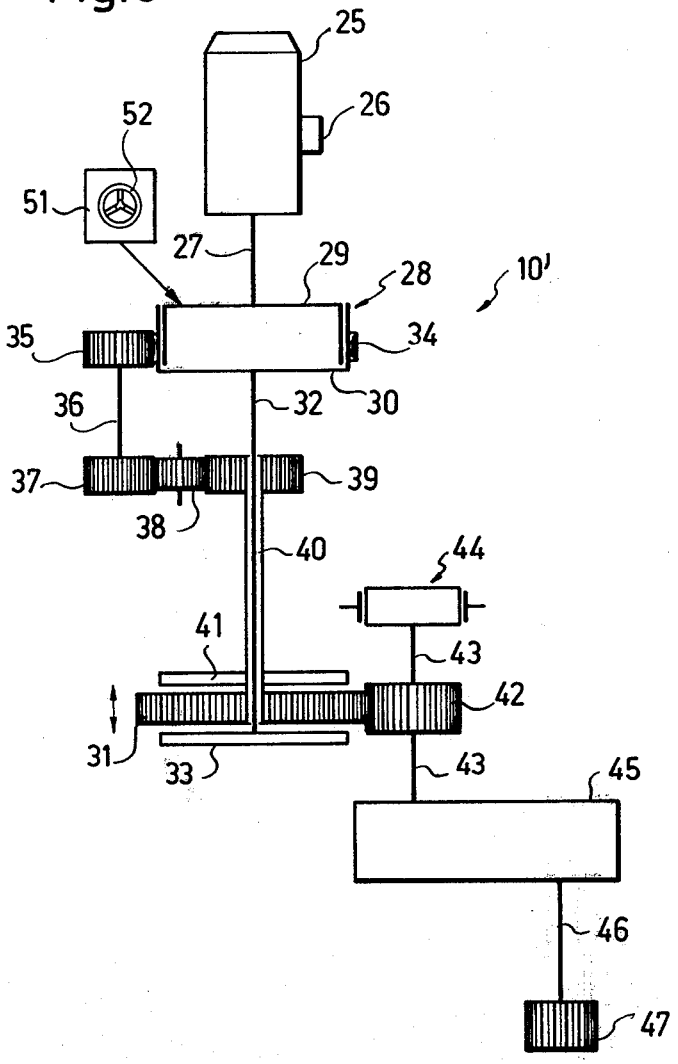
FIG. 3 illustrates another drive arrangement for use in the crane of FIG. 1.

Another drive mechanism 10' which may replace the mechanism 10 in the crane of FIG. 1 is shown in FIG. 3. It includes an air-cooled electric motor 25, not capable of being reversed and carrying a starter box 26. The output shaft 27 of the motor is secured to the driven member 29 of an eddy current coupling 28. The driving member 30 of the coupling carries a shaft 32, coaxial with the shaft 27, whose free end is attached to a friction disc 33. A gear rim 34 on the cylindrical outer surface of the driving member0120 30 meshes with one of two gears 35, 37 on a countershaft 36. The other gear 37 meshes with an intermediate gear 38 which drives a gear 39 in a direction opposite to the direction of rotation of the shaft 32.

The gear 39 is mounted on one axial end of a hollow shaft 40 coaxially enveloping the shaft 32. A friction disc 41 is fixedly mounted on the shaft 40, and a portion of the shaft 40 axially extending beyond the disc 41 toward the disc 33 carries a gear 31 which is freely rotatable on the shaft and may be shifted axially by a fork, not shown, as indicated by a double arrow, into alternative, frictional driving engagement with the discs 33 and 41 respectively. Depending on its axial position on the shaft 40, the gear 31 turns clockwise or counterclockwise. In either position, it drivingly meshes with a pinion 42 on the input shaft 43 of a speed-reducing transmission 45 which is also provided with a brake 44. The output shaft 46 of the transmission carries a pinion 47 for engagement with the stationary gear rim 50 (FIG. 1).

The torque transmitted from the motor 25 to the pinion 47 may be controlled by a handwheel 51 on the control box 52 for the coupling 28.

While eddy current clutches or couplings 16, 28 have been described with reference to FIGS. 2 and 3, other magnetic couplings may be substituted, such as electromagnetic fluid clutches whose slip is readily varied by means of simple electrical control devices.

It should be understood, of course, that the foregoing disclosure relates only to preferred embodiments of the invention, and that it is intended to cover all changes and modifications of the examples of the invention herein chosen for the purpose of the disclosure which do not constitute departures from the spirit and scope of the invention set forth in the appended claims.

What is claimed is:

1. In a rotary crane having a base portion, a boom-carrying portion, and drive means for rotating said boom-carrying portion relative to said base portion about an upright axis, the improvement in said drive means which comprises:

a. an electric squirrel-cage motor rotating continuously in one direction when energized;

b. a drive element rotatably mounted on one of said portions and drivingly engaging the other one of said portions for rotating the boom-carrying portion;

c. motion-transmitting means operatively interposed between said motor and said drive element, said motion-transmitting means including 1. an electromagnetic coupling having an input shaft operatively connected to said motor and an output shaft operatively connected to said drive element, 2. manually operable control means for varying slip in said coupling and for thereby varying the torque transmitted from said motor to said drive element; and d. brake means for braking said drive element when said coupling does not transmit significant torque to said drive element.

2. In a crane as set forth in claim 1, said motion-transmitting means further including means for reversing the direction of rotation of said drive element while said motor rotates continuously in said one direction.

3. In a crane as set forth in claim 1, said motion-transmitting means further including a speed-reducing transmission, said coupling being operatively interposed between said motor and said transmission.

4. In a crane as set forth in claim 3, said speed-reducing transmission having an input shaft operatively connected to said coupling and an output shaft operatively connected to said drive element, said brake means braking said input shaft of said speed-reducing transmission when said coupling does not transmit significant torque to said drive element.

* * * * *